United States Patent [19]

Van Sickle

[11] 3,997,861

[45] Dec. 14, 1976

[54] INTERLOCK CIRCUIT OVERRIDE RELAY

[75] Inventor: James R. Van Sickle, Mount Clemens, Mich.

[73] Assignee: Essex International, Inc., Fort Wayne, Ind.

[22] Filed: June 12, 1975

[21] Appl. No.: 586,298

[52] U.S. Cl. ..... 335/161; 335/169

[51] Int. Cl.[2] ..... H01H 9/20

[58] Field of Search ..... 335/160, 161, 164, 166, 335/169, 170, 171, 186, 238, 253, 254

[56] References Cited

UNITED STATES PATENTS

| | | | |
|---|---|---|---|
| 3,864,650 | 2/1975 | Evans | 335/186 |
| 3,893,054 | 7/1975 | Marcoux et al. | 335/186 X |
| 3,925,742 | 12/1975 | Muench | 335/170 X |

*Primary Examiner*—George Harris

[57] ABSTRACT

An interlock circuit override relay for providing a single energization bypass of an interlock circuit for each manual actuation of the relay, the relay being especially useful for bypassing the ignition seat belt interlock circuit employed in late model automobiles. The relay is so designed that closing of its interlock system bypass contacts requires a depression and subsequent release of a manually operated push button in a manner such that the bypass contacts cannot be held closed by taping down the push button. The contacts are held closed by a solenoid controlled latch whose solenoid is energized during energization of the bypass circuit. Deenergization of the bypass circuit restores the contacts to their normal open position. An improved mechanical coupling between the latch and solenoid armature compensates for minor mechanical misalignment and improves the magnetic field configuration.

21 Claims, 12 Drawing Figures

INTERLOCK CIRCUIT OVERRIDE RELAY

This invention relates to an override relay construction especially adapted to bypass an automobile-starter-seat belt interlock circuit, but which is useful in other applications where it is desired to limit override operation to a single override for each manual actuation of the relay.

Recently enacted federal law requires new automotive vehicles to be provided with a seat belt interlock system which will prevent the vehicle from being started unless the driver and the right front seat passenger have their seat belts latched. It is thus customary to provide an override switch which can be employed to permit starting of the car in the event of a malfunction in the seat belt interlock circuit. To prevent such an override switch from being used habitually to bypass the interlock system, the override switch is designed in a manner such that it is less convenient to use than to employ the seat belt. The override device is thus normally mounted in the engine compartment and is designed to reset automatically to its normal open condition after each use of the override device.

The principal object of the present invention is to perform the desired function with a simple solenoid controlled, mechanical latch in which the bypass contacts are automatically restored to their normal open position when the ignition switch is turned off.

Apparatus constructed according to the invention employs a pair of spring leaf contacts vertically spaced from each other and normally biased to an open position. A first vertically movable plunger, which forms part of an externally accessible manual push button, carries a contact engaging finger which passes freely through an opening in the upper contact leaf and rests against the upper side of the lower of the spring leaf contacts. A second plunger carries an arm which slidably receives the finger on the first plunger and engages the upper side of the upper contact. Both plungers are slidably mounted upon a post within the relay housing and are independently spring biased to an upper or rest position in which the second plunger is engaged with the lower end of the first plunger. The second plunger is provided with two outwardly projecting latch teeth, one tooth being located slightly below the other. A horizontally reciprocable latch member is formed with an enlarged opening surrounding the second plunger. The latch member is spring biased to a position which will enable it to be cammed to one side to permit both latch teeth on the second plunger to pass below the latch member. The biasing spring then restores the latch member to a position where it engages the uppermost latch tooth to retain the second plunger in the lowered position, to which it has been driven by depression of the manual push button on the first plunger. This mechanically latched condition of the second plunger maintains the upper contact, with which the second latch member arm is engaged, in a lowered position, while the lower of the two contacts is free to attempt to return to its original position when the manual push button is released and the first plunger returns to its rest position. However, in attempting to return to its original position, the lower contact is driven into engagement with the upper contact to close a circuit.

The latch plate is loosely coupled to the armature via a metal flux plate in a manner which compensates for minor misalignment and is biased to the deenergized position by a spring system coupled to the latch plate.

This arrangement permits a more efficient magnetic coupling between the pole piece and armature.

The two contacts of the override device are connected in a circuit to bypass the ignition interlock system. The latch member is coupled to the armature of a solenoid which in a typical circuit is electrically connected to be energized when the ignition switch is on. with this typical circuit arrangement, should the seat belt interlock circuit malfunction, a manual depression of the pushbutton of the override device will latch the second plunger in a depressed position regardless of whether the solenoid is energized or deenergized so that the plunger can be manually depressed whether the ignition switch is on or off. When the ignition switch is turned on, the solenoid is energized the latch member is drawn in to engage the lower of the two latch teeth which maintains the spring contacts in a closed position. Operation of the starter motor is independent of the solenoid energizing circuit, hence the starter motor may be operated as many times as desired as long as the ignition switch is not turned to its off position.

When the ignition switch is turned to its off position, the latch member is restored to its original position by the spring bias, thus drawing the latch member clear of the lower tube to permit the second plunger to return to its original position, in which the spring contacts are open.

Other features of the invention will become apparent by reference to the following specification and to the drawings, in which.

Figure 1:
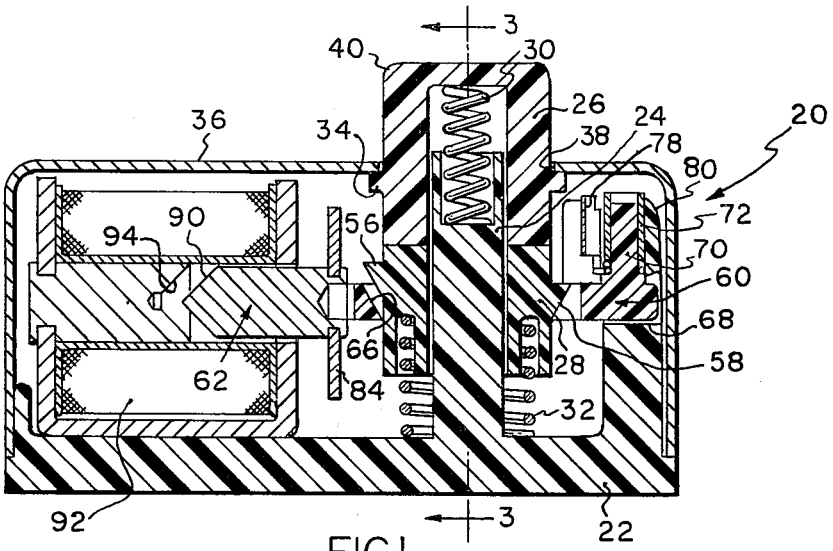
FIG. 1 is a longitudinal, vertical section through an override relay embodying the present invention, the parts occupying their normal or rest positions, and the section being taken on the line 1—1 of FIG. 3.
Figure 2:
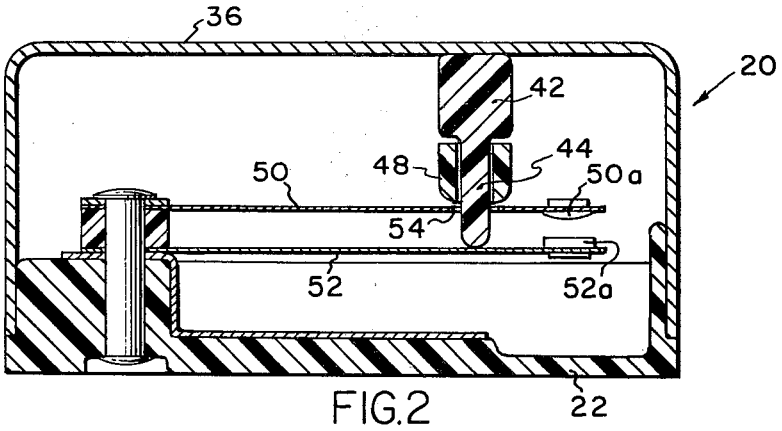
FIG. 2 is a cross sectional view taken on the line 2—2 of FIG. 3.
Figure 4:
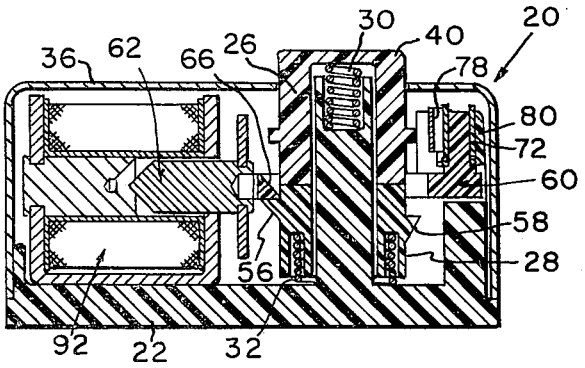
Figure 5:
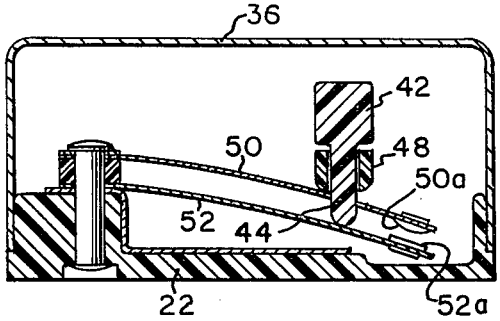
Figure 6:
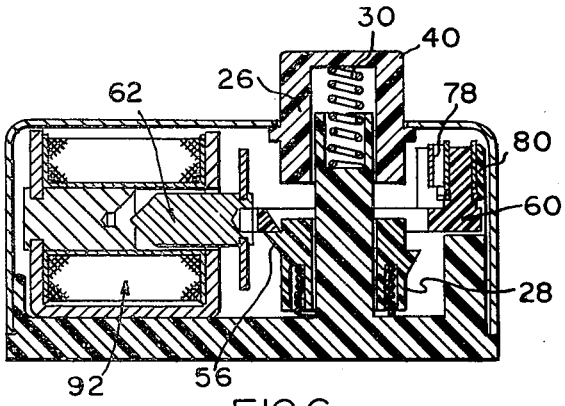
Figure 7:
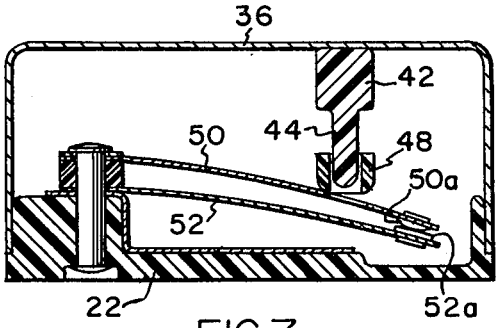
Figure 8:
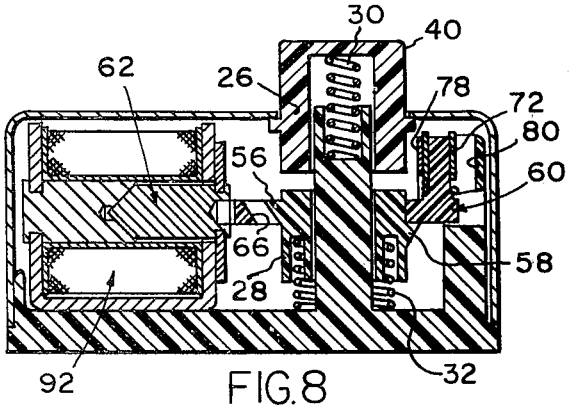
Figure 9:
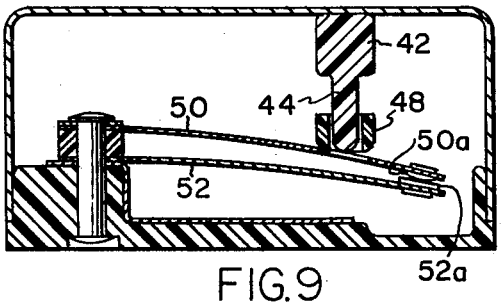
Figure 10:
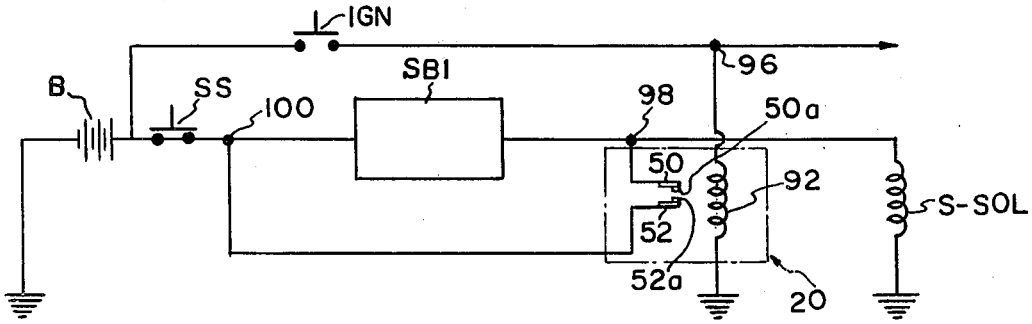
Figure 11:
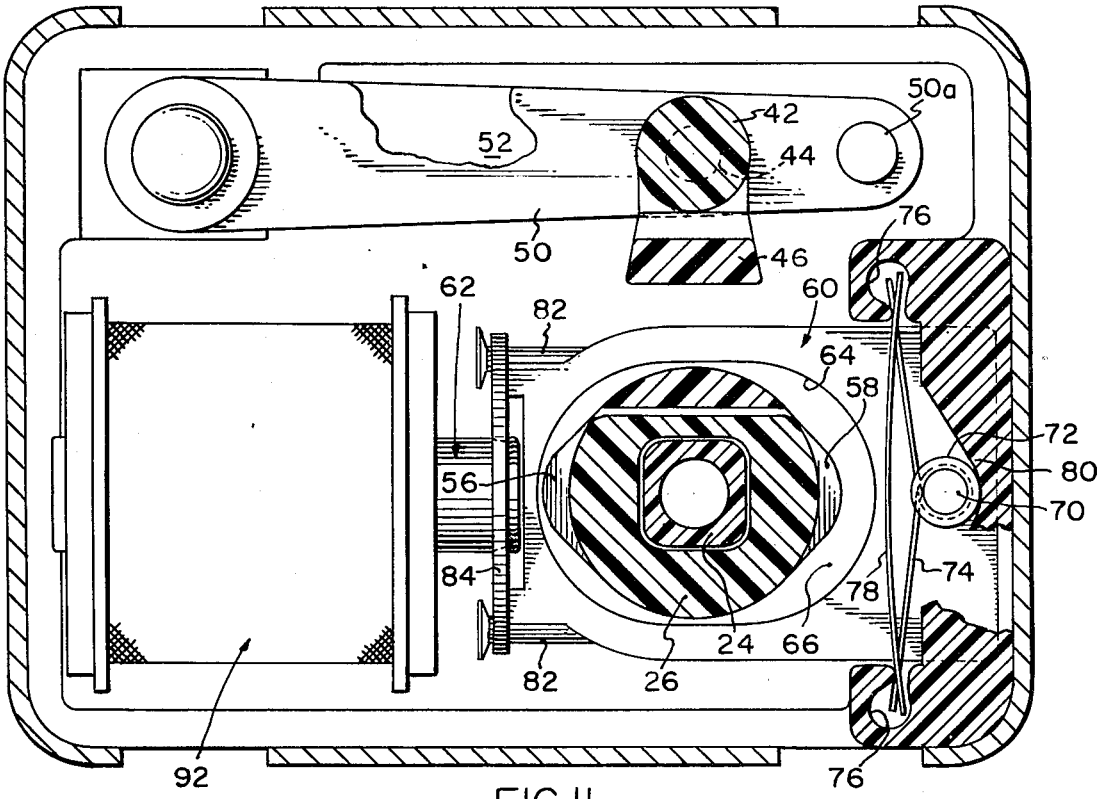
Figure 12:
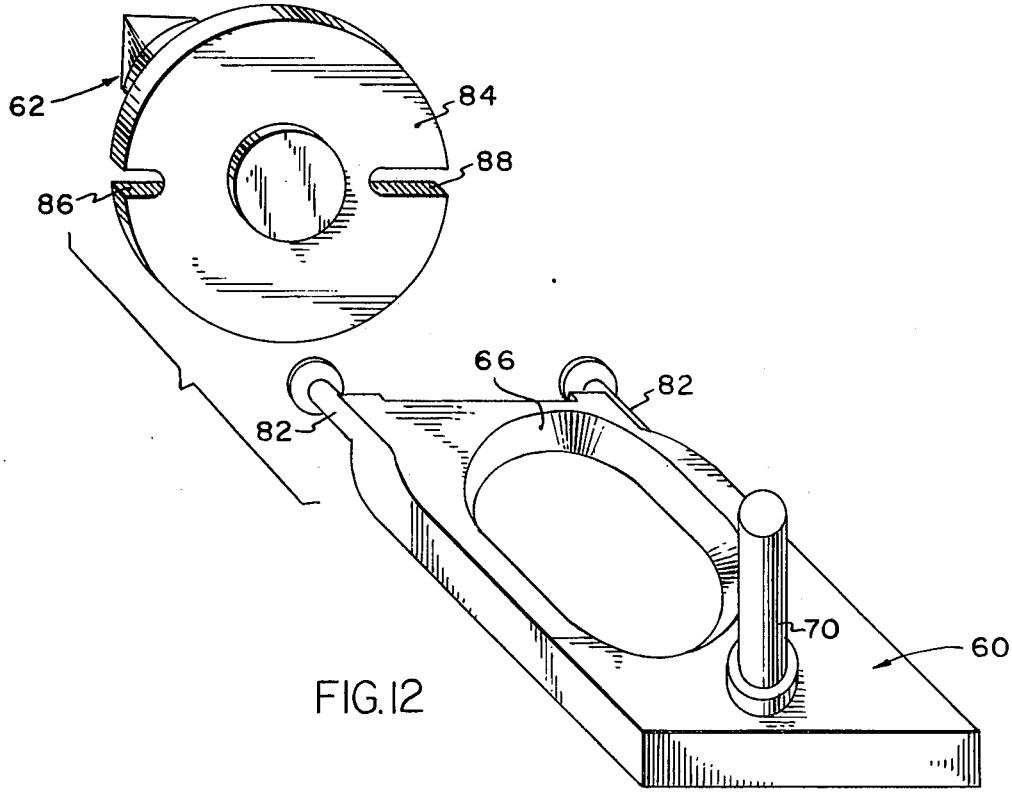

FIGS. 4, 6, and 8 are cross sectional views similar to FIG. 1, but illustrating different stages of operation of the apparatus;

FIGS. 5, 7, and 9 are cross sectional views similar to FIG. 2 and illustrating the stages of operation of FIGS. 4, 6, and 8, respectively;

FIG. 10 is a schematic diagram of a typical circuit incorporating a relay of the invention;

FIG. 11 is a top plan view, with certain parts broken away or shown in section of the relay of FIG. 1; and FIG. 12 is an exploded perspective view of the solenoid armature-latch member units.

A relay embodying the present invention is designated generally 20 and includes a housing having a base 22 formed with an upwardly projecting post 24. A first or upper plunger 26 and a second or lower plunger 28 are slidably received on post 24 for guided vertical movement and are normally biased to the rest position shown in FIGS. 1 – 3 by an upper plunger spring 30 and a lower plunger spring 32. A projecting flange 34 on upper plunger 26 engages the underside of the housing cover 36 to establish an upper end limit of movement of the two plungers, lower plunger 28 being engaged by the bottom of upper plunger 26. Cover 36 is formed with a hole 38 which freely receives the upper or push button portion 40 of upper plunger 26, with push button 40 projecting from the exterior of the housing when in the normal position as shown in FIGS. 1 and 3.

Figure 3:
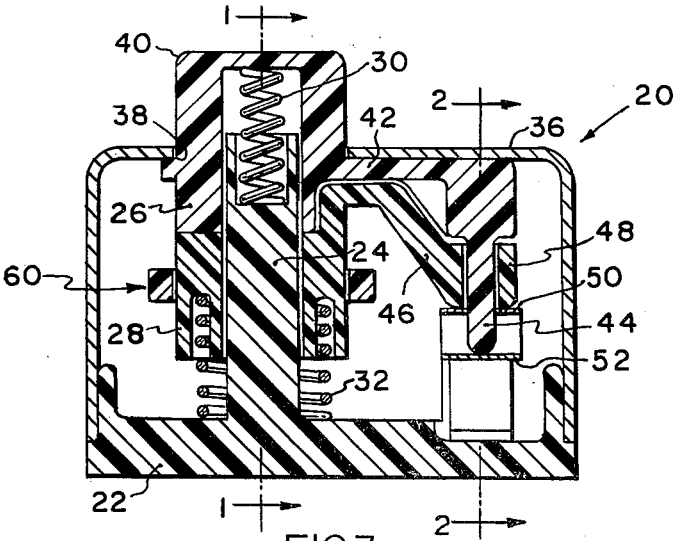
FIG. 3 is a cross sectional view taken approximately on the line 3—3 of FIG. 1.

As is best shown in FIG. 3, plunger 26 is formed with an integral horizontally projecting arm 42 having a downwardly projecting finger 44 at its outer end. A second arm 46 integral with lower plunger 28 projects outwardly in underlying relationship with arm 42 and is formed with an integral sleeve 48 at its distal end which slidably receives finger 44 of upper plunger 26.

Within the switch housing is mounted a pair of vertically opposed, cantilever spring leaf contact arms 50 and 52 (FIG. 2) having spaced, opposed contacts 50*a*, 52*a* at their free ends.

When plungers 26 and 28 are in the normal rest position shown in FIGS. 1 – 3, finger 44 projects downwardly through sleeve 48 and through an opening 54 in upper contact arm 50, the lower end of finger 44 being seated upon the upper side of lower contact arm 52 to establish a rest position of the upwardly biased arm 52 where its contact 52*a* is held in spaced relation to the opposed contact 50*a* of upper arm 50. Sleeve 48 of lower plunger 28 establishes a similar rest position for upper contact arm 50, it being understood that the spring leaf arms 50 and 52 are provided with a bias which would cause them normally to curve somewhat upwardly from the horizontal position shown in FIG. 2 were they not retained in the illustrated position by their engagement with sleeve 48 and finger 44, respectively.

The lower plunger 28 is formed with diametrically opposed, vertically offset latch teeth 56 and 58 (FIG. 1) having flat upper surfaces and downwardly inclined lower surfaces. The flat upper surface of latch tooth 56 is offset vertically upwardly from the flat upper surface of latch tooth 58 for a reason which will be explained below.

Referring particularly to FIGS. 1, 2 and 12 a flat latch plate designated generally 60 is coupled to a solenoid armature designated generally 62 for horizontal reciprocatory movement within the housing. As best seen in FIG. 12, latch plate 60 is constructed with an elongate slot 64 rounded at its opposite ends and dimensioned, as best seen in FIG. 11, to permit passage of the lower plunger 28 through the slot. The left hand end of slot 64, as viewed in FIGS. 1 and 11, is bevelled as at 66 so that latch tooth 56 can cam plate 60 to the left upon downward movement of plunger 28. A flat surface 68 in the end wall of the housing (FIG. 1) slidably supports the distal end of latch plate 60.

At the outer end of plate 60, an upstanding post 70 is integrally formed. A bushing 72 is press fitted onto post 70 to define a groove at the bottom of the post which axially locates the coil of a safety pin type spring 74, the coil of spring 74 being wrapped around the post 70 below bushing 72. As best seen in FIG. 11, the opposite ends of spring 74 are received within and bear against the sides of openings 76 formed in the switch housing. Spring 74 biases latch plate 60 and the coupled solenoid armature 62 to the right as viewed in FIGS. 1 and 11. Movement of latch plate 60 and solenoid armature 62 to the right, i.e., axially of the armature under the bias of the spring 74 is limited by an abutment surface 80 formed on housing 22 which engages the bushing on post 70. A second leaf spring 78 cushions movement of latch plate 60 to the left as viewed in FIGS. 1 and 11.

Latch plate 60 is detachably coupled to armature 62 by a pair of forwardly projecting headed coupling pins 82 which are either formed integrally with or otherwise fixedly secured to latch plate 60. A metal flux plate 84 is fixedly mounted, as by crimping, upon the exposed end of armature 62 and a pair of diametrically opposed slots 86 and 88 (FIG. 12) are formed in flux plate 84, the slots having a width greater than the shank diameter of pins 82 and less than the head diameter of the pins. As best seen in FIG. 12, slot 88 is cut somewhat deeper than slot 86, the distance between the inner end of slot 88 and the diametrically opposed mouth of slot 86 being slightly less than the distance between the two coupling pins 82 so that the latch plate 60 may be coupled to the armature 62 by first inserting one pin 82 into slot 88, moving the pin then to the inner end of slot 88, at which time the opposite pin 82 may be introduced into slot 86. This arrangement permits a limited degree of relative movement of latch plate 60 in lateral directions relative to armature 62 which may be necessary to compensate for minor misalignment.

As best seen in FIG. 1, the opposite or inner end of armature 62 is beveled as at 90 and the pole piece of the solenoid coil 92 is counterbored as at 94, this arrangement enhancing the magnetic coupling between the pole piece and armature. Solenoid coil 92 is mounted at a fixed location on base plate 22.

Suitable electrical connections are led from the opposite ends of the coil wire of solenoid coil 92 and from the electrical spring contacts 50 and 52 to the exterior of the housing. These electrical leadouts are not shown since they may vary with different mounting arrangements of the switch and the design of such leadouts is well within the capabilities of one skilled in the art.

OPERATION

The switch described above in a typical operational arrangement is connected into the ignition circuit of an automobile as shown in FIG. 10. Solenoid coil 92 is electrically connected between ground and a point 96 in the ignition switch circuit to be energized from battery B at all times when the ignition switch IGN is in an "on" position.

Contact 50*a* of the switch is electrically connected to a point 98 in the starter solenoid circuit, while contact 52*a* is connected to a point 100 in the starter solenoid circuit so that the contacts 50*a* and 52*a*, when closed, electrically bypass the seatbelt interlock circuit SBI.

In normal operation, the starter solenoid circuit is energized from the battery upon closure of the starter switch SS and if the seatbelt interlock circuit is conditioned by proper closure of the various seatbelt switches (not shown), the seatbelt interlock circuit SBI electrically connects the starter solenoid S-SOL to battery B via the closed starter switch SS. When the seatbelt interlock circuit SBI is properly actuated, the starter solenoid will be energized by operation of starter switch SS regardless of whether contacts 50*a* and 52*a* are open or closed.

The normal or inactive position of the relay of the present invention is that shown in FIGS. 1 and 2 of drawings in which the upper and lower plungers 26 and 28 are in their elevated position as shown in FIG. 1 which positions the finger 44 attached to upper plunger 26 and the sleeve 48 attached to lower plunger 28 in the positions shown in FIG. 2, contacts 50*a* and 52*a* a being open in this position.

In the event of a malfunction of the seatbelt interlock circuit SBI the relay of the present invention is employed to electrically bypass circuit SBI in the manner shown in FIGS. 4 through 9.

Assuming the ignition switch IGN is in the off position, thus leaving solenoid coil 92 deenergized, pushbutton 40 is depressed as shown in FIG. 4 to condition the relay for operation. As the button is depressed from the position shown in FIG. 1 to that shown in FIG. 4, the inclined lower surface of latch tooth 56 engages the beveled surface 66 on latch plate 60 to mechanically shift latch plate 60 and solenoid armature 62 to the left against the action of spring 74 to permit latch tooth 56 to move downwardly below latch plate 60 into the position shown in FIG. 4. FIG. 5 shows the position of contacts 50*a* and 52*a* when the pushbutton 40 is in the fully depressed position shown in FIG. 4. It will be noted that contacts 50*a* and 52*a* are open at this time. This arrangement effectively prevents employing the relay to permanently bypass the seatbelt interlock circuit by taping the pushbutton 40 in its depressed position, because this action will leave contacts 50*a* and 52*a* open as indicated in FIG. 5.

Upon subsequent release of pushbutton 40, upper plunger 26 is restored to its original position by the action of spring 30. This situation is shown in FIG. 6. Lower plunger 28, as seen in FIG. 6, remains in its lowered position since it is held in this position by the engagement of latch tooth 56 beneath latch plate 60. Referring to FIG. 7 which shows the position of the contact corresponding to the plunger position of FIG. 6, it is seen that the return of upper plunger 26 to the FIG. 6 position shifts the attached finger 44 upwardly clear of contact spring 52 so that contact 52*a* is free to move upwardly from the position of FIG. 5. However, sleeve 48 which is attached to the lower plunger 28 remains stationary, and hence contact 50*a* cannot move upwardly. This causes contact 52*a* to engage contact 50*a*.

Upon subsequent energization of solenoid 92, latch plate 60 is drawn to the left from its FIG. 6 position to that of FIG. 8. This movement of latch plate 60 shifts the plate to the left clear of latch tooth 56 so that lower plunger 28 can move upwardly from the FIG. 6 position, however, the latch plate has now shifted into overlying relationship with latch tooth 58 so that the plunger 28 moves up only slightly from the FIG. 6 position. Referring now to FIG. 9, which corresponds to the plunger positions of FIG. 8, it is seen that sleeve 48, which is coupled to lower plunger 28, has moved up slightly from the FIG. 7 position, but not by an amount sufficient to enable contact arm 50 to return to its normal horizontal position (FIG. 2) and thus still maintains contact between contact 50*a* and contact 52*a*.

Referring now to the circuit of FIG. 10, it is seen that with contacts 50*a* and 52*a* engaged as in FIG. 9, the relay establishes an electrical connection between points 100 and 98 in the starter solenoid circuit so that the starter solenoid can be energized upon closure of starter switch SS. Contacts 50*a* and 52*a* will remain in the FIG. 9 position as long as solenoid coil 92 remains energized or, in terms of the circuit of FIG. 10 contacts 50*a* and 52*a* will remain closed until the ignition switch is subsequently moved to ist off position. This circuit arrangement permits as many operations of the starter as may be necessary to start the engine.

Upon deenergization of solenoid coil 92, latch plate 60 and solenoid armature 62 are restored to the FIG. 1. position by the latch plate return spring 74, thus withdrawing latch plate 60 clear of latch tooth 58 to permit spring 32 to restore lower plunger 28 to the FIG. 1 position, in which the spring contacts 50 and 52 are restored to the FIG. 2 position with contacts 50*a* and 52*a* opened.

While one embodiment of the invention has been described in detail, it will be apparent to those skilled in the art that the embodiment described may be modified. Therefore, the foregoing description is to be considered exemplary rather than limiting, and the true scope of the invention is that defined in the following claims.

What is claimed is:

1. An override reset relay comprising a housing, a pair of opposed contact means mounted in said housing and biased to a normal open rest position, first plunger means movably mounted in said housing engageable with one of said contact means and normally maintained in a rest position accommodating movement of said one of said contacts to its rest position, second plunger means movably mounted in said housing in engagement with the other of said contact means and normally maintained in a rest position locating said other of said contacts in its rest position, first latch means in said housing operable upon displacement of said first and second plunger means from their respective rest positions to an actuated position to prevent return of said second plunger means to its rest position upon return of said first plunger means to its rest position, said other of said contact means being maintained in an actuated position by said second plunger means when engaged by said first latch means and said one contact means being movable into contact with said other contact means in its actuated position upon return of said first plunger means to its rest position, and latch control means operable by successive energization and deenergization of an electric circuit through the closed contact means for restoring said second plunger means and both of said contact means to their respective rest positions.

2. A relay as defined in claim 1 wherein said first latch means comprises a solenoid mounted in said housing and having an armature biased to a first normal rest position when solenoid is deenergized, a latch member coupled to said armature for movement therewith and having a first latching shoulder, and a first latch tooth on said second plunger means movable into latched engagement with said first shoulder when said solenoid is deenergized and said second plunger means is moved from its rest position to its actuated position.

3. A relay as defined in claim 2 wherein said solenoid is operable when energized to shift said latch member to a retracted position wherein said first shoulder is disengaged from said first latch tooth, a second shoulder on said latch member, and a second latch tooth on said second plunger means engageable with said second shoulder upon release of said first latch tooth from said first shoulder by movement of said latch member to its retracted position, said second latch tooth when engaged with said second shoulder being operable to latch said second plunger in a position closely adjacent its actuated position wherein said contact means are engaged with each other.

4. A relay as defined in claim 3 wherein said plungers are mounted for movement in an axial path and said latch member is movable in a path normal to said axial path, said latch tooth being axially offset on said second plunger means from said second latch tooth by a distance such that said first latch tooth is axially offset from said first shoulder when said second tooth is engaged with said second shoulder.

5. A relay as defined in claim 4 wherein said armature is spring biased to its rest position wherein said first shoulder is projected into the axial path of movement of said first tooth, and complementary cam surfaces on said first shoulder and first tooth for shifting said armature temporarily to one side to accommodate movement of said first tooth axially past said first shoulder during movement of said second plunger means from its rest position to its actuated position.

6. Apparatus as defined in claim 1 wherein said plunger means are mounted for coaxial movement along an axial path, independent spring means biasing each of said plunger means in the same direction to their respective rest positions at one end of said axial path wherein said second plunger means is biased against said first plunger means, said contact means being movable to and from their respective rest positions along a common path generally parallel to said axial path, first and second contact means engaging means on the respective first and second plunger means for moving said contact means from their rest position upon movement of said plunger means from their rest positions, said engaging means being operable to maintain said contact means in a normal open spaced relationship whenever said plunger means are engaged with each other.

7. A relay as defined in claim 6 wherein said second engaging means comprises a sleeve having one end engaged with said other of said contact means, said other of said contact means having an opening therethrough aligned with the opening through said sleeve, and said first engaging means comprises a finger projecting through said sleeve and said opening in said other of said contact means into engagement with said one of said contact means when said plunger means are in engagement with each other.

8. An override reset relay comprising a housing having a base, a vertical post projecting upwardly from said base, upper and lower plunger members slidably mounted on said post, spring means independently biasing said plunger members upwardly on said post to a rest position wherein the lower plunger is engaged with said upper plunger, push button means at the upper end of said upper plunger member for manually depressing said plunger members downwardly along said post from said rest position, vertically spaced upper and lower contact means independently resiliently biased to a normal open rest position, first engaging means on said upper plunger member engageable with said lower contact means to move said lower contact means downwardly from its rest position upon movement of said upper plunger downwardly from its rest position, second engaging means on said lower plunger member engaging the upper side of said upper contact means, and latch means in said housing operable to releasably latch said lower plunger member in either of a first or a second position displaced downwardly from its rest position wherein said lower contact means engages said upper contact means when said upper plunger is in its rest position.

9. A relay as defined in claim 8 wherein said latch means comprises a solenoid having a latching armature operable when said solenoid is deenergized to latch said lower plunger member in said first position and operable when said solenoid is energized to latch said lower plunger member in said second position.

10. A relay as defined in claim 9 wherein said first position of said lower plunger member is below said second position.

11. A relay as defined in claims 10 wherein said latching armature comprises a horizontally movable latch plate having an opening therethrough accommodating movement of said lower plunger member vertically through said plate, a first latch tooth projecting from one side of said lower plunger member engageable beneath said plate at one side of said opening to latch said lower plunger member in said first position when said solenoid is deenergized to locate said plate in a normal position, and a second latch tooth projecting from the opposite side of said lower plunger member engageable beneath said plate at the opposite side of said opening to latch said lower plunger member in said second position when said solenoid is energized to locate said plate in an off-normal position.

12. A relay as defined in claim 11 further comprising sprinng biasing means biasing said plate to said normal position when said solenoid is deenergized, said first tooth on said lower plunger member being located above said plate when said lower plunger is in its rest position, and complementary cam surfaces on said first latch tooth and said plate for shifting said plate from said normal position against the spring bias to permit downward movement of said lower plunger member to said second position upon manual depression of said upper plunger member.

13. A relay as defined in claim 12 wherein the upper surface of said first latch tooth is located above the lower surface of said plate at said one side of said opening when said lower plunger member is in said second position.

14. In a mechanically latched solenoid actuated relay having a housing, a solenoid coil mounted in said housing, a pole piece, an armature mounted in one end of said housing, a pole piece, an armature mounted in one end of said coil for sliding movement toward and away from said pole piece, a latch plate supported in said housing for sliding movement toward and away from said one end of said coil and means coupling said latch plate to said armature; the improvement wherein said coupling means comprises means accommodating lateral and limited axial movement of said plate relative to said armature, and spring means engaged between said housing and said latch plate resiliently biasing said latch plate and the coupled armature away from said pole piece.

15. The invention defined in claim 14 wherein said coupling means comprises a metal plate fixedly secured to and extending radially of said armature at the exterior of said coil, means defining an opening in said metal plate, and a coupling element projecting from said latch plate loosely through said opening and engageable with the face of said metal plate remote from said latch plate to prevent axial withdrawal of said element from said opening.

16. The invention defined in claim 14 wherein said opening comprises a pair of diametrically opposed slots extending radially inwardly from the periphery of said metal plate and said coupling element comprises a pair of spaced pins projecting from said latch plate through the respective slots, said pins having enlarged head portions wider than said slots to limit axial withdrawal of said latch plate from said metal plate.

17. The invention defined in claim 16 wherein one of said slots extends radially inwardly of said metal plate by a greater distance than the other of said slots, the distance between the radially inner end of said one of said slots and the periphery of said plate at the mouth of the other of said slots slightly exceeding the spacing between said pins.

18. The invention defined in claim 14 wherein the end of said armature adjacent said pole piece is of conical configuration, and means defining a complementary conical recess in the portion of said pole piece adjacent said armature adapted to receive said conical end of said armature when said solenoid coil is energized.

19. The invetnion defined in claim 14 wherein said spring means comprises a first spring element continuously biasing said latch plate outwardly from said pole piece and a second spring element engageable with said latch plate to augment the biasing action of said first spring element when said latch plate moves to or inwardly beyond a predetermined distance from said pole piece.

20. The invention defined in claim 19 wherein said spring means comprises a post fixed to and projecting from said latch plate, said first spring element being coupled between said post and said housing to continuously bias said latch plate outwardly from said pole piece, and abutment means on said housing engageable with said post to establish an outer limit of movement of said latch plate relative to said pole piece.

21. The invention defined in claim 20 wherein said second spring element comprises a spring leaf mounted on said housing and projecting across the path of movement of said post at a location spaced inwardly from said post when said post is engaged with said abutment.

* * * * *

UNITED STATES PATENT AND TRADEMARK OFFICE

CERTIFICATE OF CORRECTION

PATENT NO. : 3,997,861
DATED : December 14, 1976
INVENTOR(S) : James R. VanSickle It is certified that error appears in the above-identified patent and that said Letters Patent are hereby corrected as shown below:

Column 2, line 8, change "with" to -- With -- .

Column 3, line 59, insert a comma (,) after "armature".

Column 4, line 61, delete "a" at the end of the line.

Column 5, line 58, change "ist" to -- its -- .

Column 5, line 62, delete the period (.) at the end of the line.

Column 6, line 39, insert -- said -- after "when".

Column 8, line 1, change "claims" to -- claim -- .

Column 8, line 17, change "sprinng" to -- spring -- .

Column 8, lines 35 and 36, delete "housing, a pole piece, an armature mounted in one end of said".

Column 9, line 10, change "invetnion" to -- invention -- .

Signed and Sealed this

First Day of March 1977

[SEAL]

*Attest:*

RUTH C. MASON
*Attesting Officer*

C. MARSHALL DANN
*Commissioner of Patents and Trademarks*